US006588512B2

(12) United States Patent
Sundholm

(10) Patent No.: US 6,588,512 B2
(45) Date of Patent: Jul. 8, 2003

(54) FIRE EXTINGUISHING INSTALLATION WITH VALVE COMPRISING A SPINDLE

(75) Inventor: Göran Sundholm, Tuusula (FI)

(73) Assignee: Marioff Corporation Oy, Vantaa (FI)

( * ) Notice: Subject to any disclaimer, the term of this patent is extended or adjusted under 35 U.S.C. 154(b) by 0 days.

(21) Appl. No.: 10/292,411

(22) Filed: Nov. 12, 2002

(65) Prior Publication Data

US 2003/0079888 A1 May 1, 2003

Related U.S. Application Data

(63) Continuation of application No. PCT/FI01/00541, filed on Jun. 7, 2001.

(51) Int. Cl.[7] ..... A62C 35/00

(52) U.S. Cl. ..... 169/5; 169/9; 169/14; 169/65

(58) Field of Search ..... 169/9, 14, 65, 169/5, 15, 16, 85; 239/569, 570, 398, 407, 412, 417.5

(56) References Cited

U.S. PATENT DOCUMENTS

| | | | | | |
|---|---|---|---|---|---|
| 4,064,944 | A | * | 12/1977 | McClure et al. | 169/60 |
| 5,713,417 | A | | 2/1998 | Sundholm | 169/46 |
| 5,738,174 | A | * | 4/1998 | Sundholm | 169/46 |
| 5,785,126 | A | | 7/1998 | Olsson | 169/46 |
| 5,797,457 | A | * | 8/1998 | Sundholm | 169/46 |
| 5,845,713 | A | * | 12/1998 | Sundholm | 169/9 |
| 5,845,714 | A | * | 12/1998 | Sundholm | 169/46 |
| 5,944,112 | A | * | 8/1999 | Sundholm | 169/9 |
| 6,102,127 | A | | 8/2000 | Pierce | 239/75 |

FOREIGN PATENT DOCUMENTS

| | | | |
|---|---|---|---|
| EP | 0868928 | 10/1998 | |
| JP | 11192320 | 7/1999 | |
| WO | WO 94/14501 | * 7/1994 | A62C/35/68 |
| WO | 9528204 | 10/1995 | |

OTHER PUBLICATIONS

Patent Abstract of Japan, 11–192320 A Filed Jul. 21, 1999.

* cited by examiner

*Primary Examiner*—Michael Mar
*Assistant Examiner*—Darren Gorman
(74) *Attorney, Agent, or Firm*—Ladas & Parry

(57) ABSTRACT

A fire extinguishing installation comprising a liquid container (3), a gas container (1), and a feed line (4) to at least one spray head (5), the gas container being connected at a connection point (K) via a second line (6) to the feed line, and a valve (9) connected to the outlet (U) of the liquid container and to the feed line. In order for the fire extinguishing installation to be suitable particularly for extinguishing liquid fires without it causing splashing of the burning liquid, the valve (9) comprises a liquid space (10), connected to the feed line (4), a gas space (12), connected to the second line (6), and a spindle (13) arranged between the liquid space (10) and the gas space (12), which spindle either prevents or enables communication between an outlet (U) of the liquid container (3) and the liquid space (10).

14 Claims, 1 Drawing Sheet

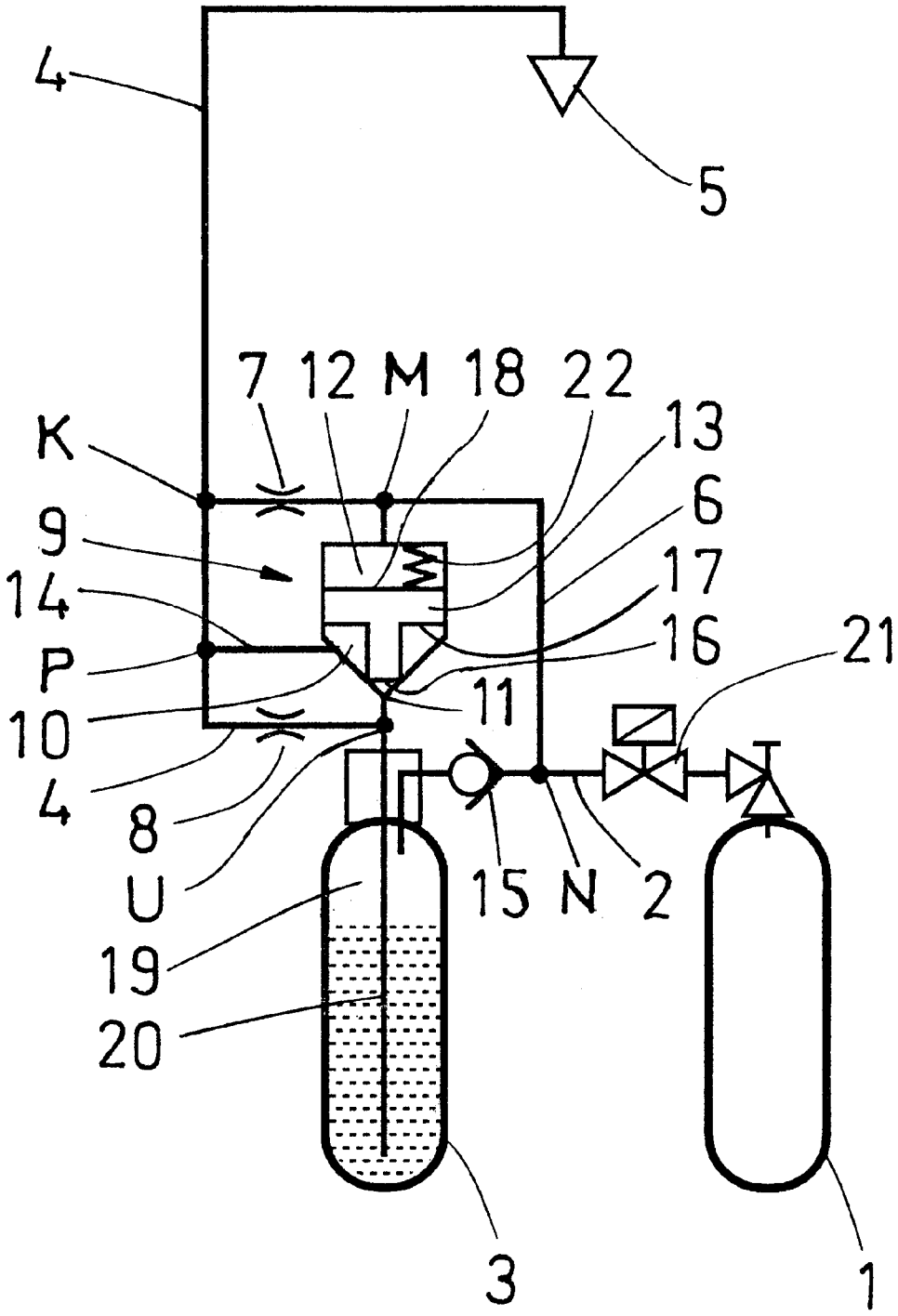
FIG.

FIRE EXTINGUISHING INSTALLATION WITH VALVE COMPRISING A SPINDLE

This application is a continuation of copending International Application PCT/FI01/00541 filed on Jun. 7, 2001, which designated the U.S., claims the benefit thereof and incorporates the same by reference.

BACKGROUND OF THE INVENTION

The invention relates to a fire extinguishing installation comprising a liquid container connected to a gas container by means of a first line for discharging liquid from the liquid container via an outlet of the liquid container and a feed line to at least one spray head, the gas container being connected at a connection point via a second line to the feed line, and a valve one opening of which is connected to the outlet of the liquid container and another opening of which is connected to the feed line. The gas container and the liquid container form a hydraulic accumulator. The fire extinguishing installation of the invention is intended for local or 'target' extinguishing and it is very well suited to extinguish liquid fires.

JP 11192320 discloses a fire extinguishing installation of the above type. The installation mixes gas and water at a predetermined ratio into a supply pipe. WO 95/28204 discloses a fire fighting installation enabling the mixture of gas with liquid so as to achieve an extinguishing medium, which is a mixture of very small mist-like droplets and gas.

When burning liquids are extinguished at close range and water is used in the local extinguishing as the extinguishing medium, a problem easily arises of the burning liquid being splashed around causing high flames. This problem arises when the burning liquid does not appear as a thin layer but is present in large amounts, typically in an open basin or vessel. The splashing is caused by the extinguishing medium (water) vaporizing and expanding at a high temperature producing a kind of a pressure shock or pressure wave at the surface of the burning liquid. The extinguishing medium can also produce a mechanical 'impact' at the surface of the liquid, causing splashing of the liquid. Even if such a fire, which sometimes resembles an ocean of flame, were extinguished, it causes danger to people nearby and may cause severe burns. Material losses may also be considerable. For example, unsuccessful extinguishing of oil burning in deep-frying pans in restaurants can lead to an ocean of flame with very unfortunate results.

Known fire extinguishing installations are efficient in extinguishing certain types of liquid fires, but their suitability to extinguishing the aforementioned liquid fires susceptible to splashing when extinguishing is not particularly good, although the installation of, for example WO 95/28204 is able to mix gas with liquid immediately at the start when the extinguishing medium starts to flow out of a spray head. This is because the extinguishing medium produced by the installations subjects the surface of the burning liquid to a considerable pressure wave and pressure.

BRIEF DESCRIPTION OF THE INVENTION

The object of the invention is to provide a fire extinguishing installation operating in two steps and providing fast extinguishing of liquid fires, and especially those involving liquid in deep basins without risk of splashing thanks to the two-step operation and preferably using an environmentally friendly extinguishing medium. The two-step operation of the extinguishing installation is typically such that the installation first supplies a large amount of very small droplets, the total amount of water being, however, very small, after which the droplet size of the extinguishing medium and the amount of liquid therein increase. The former extinguishing step may be called gentle, since it causes no splashing of the burning liquid. A fire is typically extinguished during this step. The second step provides efficient cooling of the target, thus preventing the fire from re-igniting.

This object is achieved with a fire extinguishing installation comprising a liquid container connected to a gas container by means of a first line for discharging liquid from the liquid container via an outlet of the liquid container and a feed line to at least one spray head, the gas container being connected at a connection point via a second line to the feed line, and a valve one opening of which is connected to the outlet of the liquid container and another opening of which is connected to the feed line, wherein the valve is coupled in parallel with the feed line and comprises

- a liquid space, connected via a line to the feed line;
- an inlet for liquid, connected to the outlet of the liquid container;
- a gas space, connected to the second line; and
- a spindle arranged between the liquid space and the gas space and movable from a first position, wherein it closes the inlet such that the outlet is not in communication with the liquid space via the inlet, into a second position, wherein it opens the inlet such that the outlet is in communication with the liquid space via the inlet.

Since the pressure in a gas container is preferably high from the point of view of the operation of the extinguishing installation, and the extinguishing medium is not to be supplied to the spray head at too high a pressure, it is recommendable to provide the second line with a first throttle, and arrange a second throttle, coupled in parallel with the valve, between the outlet of the liquid container and the connection point, to connect the liquid space to the feed line at a point located after the second throttle seen in the flow direction of the liquid, and to connect the gas space to the second line between the first throttle and the gas container. Two throttles provide a good operation, but one of said throttles may be omitted from the installation even in high-pressure applications.

The spindle preferably comprises an action surface, on which the liquid pressure acts when the spindle is in the first position, a shoulder surface, on which the liquid pressure acts only when the spindle is in the second position, and a gas space surface, which points at the gas space and is larger than the action surface. Such a spindle acts automatically, i.e. moves, controlled by the pressures acting at any given time in the gas and liquid containers; thus, external energy, e.g. electric energy, is not needed for controlling the valve. The spindle moves from the first position to the second position only when a liquid pressure acts on the action surface, the liquid pressure being significantly higher than the gas pressure acting on the gas space surface. The pressure acting on the gas space surface decreases as the gas container empties; and initially, as the liquid container empties, the liquid pressure acting on the action surface decreases relatively slowly compared with the decrease in the pressure acting on the gas space of the valve. This means that the gas container first supplies gas to the feed line, and the liquid container supplies liquid via the throttle to the feed line until the pressure in the gas container is decreased sufficiently low. When the pressure acting on the gas space surface decreases significantly below the liquid pressure acting on the action surface, the spindle moves from the first position to the second position. The shoulder surface allows the spindle, once it has moved from the first position to the second position, to remain for a while in a position that enables the flow of a large amount of liquid via the liquid space in the valve to the feed line and from there further to the spray head. The valve preferably comprises a spring arranged to load the spindle. The choice of spring affects the operation of the valve, and therefore a spring that has a spring constant suited to the application in question and that loads the spindle in the desired direction is selected.

Preferred embodiments of the invention are disclosed in the attached claims.

The most important advantage of the fire extinguishing installation of the invention is that it is able to first supply extinguishing medium that has a low kinetic energy and very little liquid, which, when expanding in a hot environment, is unable to cause a harmful pressure impact or pressure wave, after which the installation is able to supply extinguishing medium having relatively large drops and relatively much liquid and kinetic energy, said latter extinguishing medium causing further cooling of the fire site. Due to said two-step operation, the extinguishing medium does not break the surface of the burning liquid, which would cause splashing, but extinguishes the fire efficiently immediately at the start. Once the fire is extinguished, the extinguishing medium having much kinetic energy attends to efficient cooling and makes sure the fire does not re-ignite. An extinguishing medium having little kinetic energy contains much gas and relatively little liquid, which is mist-like. An extinguishing medium having much kinetic energy contains much mist-like liquid, the droplet size being, however, larger than in an extinguishing medium having little kinetic energy.

BRIEF DESCRIPTION OF THE FIGURES

In the following, the invention will be described in detail by means of a preferred embodiment with reference to the attached drawing.

DETAILED DESCRIPTION OF THE INVENTION

The drawing shows a simplified version of a fire extinguishing installation and its main components. The installation comprises a gas container 1, which is connected by means of a pipe 2 or other line, such as a hose, to a liquid container 3. The gas container contains nitrogen, other incombustible gas or air. The pressure in the container 1 is between 50 and 300 bar, e.g. about 200 bar. The liquid container 3 contains a hydrous substance, preferably water, which may have small additions of some substance preferably used in fire extinguishing, such as an anti-freeze agent. The gas discharged from the gas container 1 is arranged to propel liquid from the liquid container 3 via the pipe 2 via an ascending pipe 20 and an outlet U, and via a throttle 8 to a feed pipe 4 (outlet pipe) and from there further to a spray head 5.

A pipe 6 originates from point M in the pipe 2 between the gas container 1 and the liquid container 3 to the feed pipe 4. At connection point K, the pipe 6 joins the feed pipe 4. This connection enables the simultaneous supply of both gas and liquid to the feed pipe 4.

Between the ascending pipe 20 and the pipes 4, 6 is a valve 9, which is connected to the feed pipe 4 in parallel with the throttle 8. The valve 9 comprises a liquid space 10 and a gas space 12, which are separated from each other by means of a spindle 13. The spindle 13 is a piston-type of element arranged inside the cylindrical space in the valve 9. The spindle 13 comprises a cylindrical end that points at the outlet U of the liquid container and comprises an action surface 16, whose significance will be addressed later. The cylindrical end is arranged inside the cylindrical space in the valve 9. When the spindle 13 is in the position shown in the figure, it closes the inlet 11 of the valve to liquid, preventing liquid from flowing from the inlet to the liquid space 10. The spindle 13 can be moved from the position shown in the figure upwards to a position allowing the flow of liquid at the inlet to the liquid space 10. The liquid space 10 is connected via a pipe 14 to the feed pipe 4, thus allowing liquid to flow from the liquid space 10 to the feed pipe 4, when the spindle 13 is in said upper position. The throttle 8 is arranged between the outlet U of the liquid container and a connection point P where the pipe 14 is connected to the feed pipe 4.

The gas space 12 is connected to the pipe 6 so that the pressure in the gas container 1 acts on the gas space and a spindle surface 18, which may be called a gas space surface.

In the liquid space 10 in the valve, the spindle 13 comprises an annular shoulder surface 17, which centrally surrounds the action surface 16. The choice of the area of the shoulder surface 17 affects the operation of the valve 9. The total area of the shoulder surface 17 and the action surface 16 corresponds to the area of the gas space surface 18.

The pipe 6 is provided with a throttle 7 at a point that is between the connection point K and a connection point M where the valve 9 is connected to the pipe 6.

Reference 15 denotes a non-return valve that enables gas flow from the gas container 1 to the gas space 19 in the liquid container 3.

Reference 21 denotes a valve, which in an open position enables gas flow from the gas container 1 to the pipes 2 and 6. When the fire extinguishing installation operates, the valve 21 has to be open.

The operations of the fire extinguishing installation and the valve 9 therein are described in detail next.

If the spray head 5 is a sprinkler comprising an ampoule or the like (not shown) that explodes in heat, and the valve 21 is open, the fire extinguishing installation of the figure starts to operate when the ampoule breaks. If the spray head 5 does not comprise an ampoule or other component that is activated by heat, and is thus not automatically triggered, the valve 21 is normally closed. The fire extinguishing installation is activated by opening the valve 21; the valve is opened either manually or automatically by means of a signal obtained from a sensor or detector (not shown).

Irrespective of the way the extinguishing installation is activated, its actual operation is the same. First, gas flows at a high pressure (200 bar) from the gas container 1 to the pipes 2 and 6. Gas fills the gas space 19 in the liquid container 3 and causes a high pressure in the gas space 12 of the valve 9. The gas pressure in the liquid container 3 propels water via the ascending pipe 20 to the feed pipe 4 and further to the spray head 5. Gas flows via the pipe 6 to the feed pipe 4. At first, relatively much gas flows to the feed pipe 4, the gas mixes with the water in the feed pipe, and the spray head 5 emits very fine mist-like extinguishing medium having a very small liquid content. The liquid pressure in the liquid container 3 decreases slower than the pressure in the gas container 1 and the gas space 12. Fine mist-like extinguishing medium flows from the spray head 5 until the pressures in the gas container 1 and the gas space 12 in the valve fall to a value that is insufficient to keep the spindle 13 in the closed position shown in the figure, but the liquid directs such a pressure to the action surface 16 as is sufficient to lift up the spindle 13. Said fine mist-like extinguishing medium is able to efficiently extinguish a liquid fire without directing such forces to the surface of the burning liquid as would make the liquid splash. Accordingly, the fire is extinguished at this stage.

When the spindle 13 rises from the position shown by the figure, the liquid directs such a pressure to the shoulder surface 17 (and the action surface 16) that, together with the force of an extension spring 22, keeps the spindle in the upper position until the pressure in the liquid container 3 falls to a value, which is by a given value below the gas pressure in the gas space 12 of the valve. When the spindle 13 is in said upper position, there is a strong water flow from the liquid container 3 via the liquid space 10 to the feed pipe 4. There is no throttle in the pipe 14, and the flow is consequently strong. Said water flow causes mist-like extinguishing medium, composed of fine droplets and not containing gas, to flow from the spray head 5. This extinguishing medium, which contains relatively much liquid, is able to efficiently cool the surroundings of the fire, thus preventing any re-ignition of the fire. This is because small liquid droplets efficiently absorb heat. The flow via the pipe 14 continues until the pressure in the liquid space 10 of the valve sinks below the value that is able to keep the spindle 13 in the upper position. The extension spring 22 in the gas space 12 tends to pull the spindle 13 upwards. Without the extension spring 22, the spindle 13 would fall downward when the liquid pressure in the liquid space 10 drops below the gas pressure in the gas space 12. Because of the extension spring 22, the liquid pressure in the liquid space 10 is below the gas pressure in the gas space 12 by a certain value before the valve 9 closes. When the spindle 13 falls to the lower level shown in the figure, gas again starts to flow via the pipe 6 to the feed pipe 4, the flow being again succeeded by a liquid flow via the valve 9 and the pipe 14 to the feed pipe. The spindle 13 in the valve continues its reciprocating movement until the gas container and the liquid container are empty.

The spring characteristics of the extension spring 22 determine the stage at which the valve 9 opens for the first time. If the spring constant of the extension spring 22 is high (i.e. strong spring), the valve 9 opens early; if the spring constant is low (i.e. weak spring), the valve opens late. The spring 22 is selected e.g. such that the valve 9 opens after about 3 minutes, which again means that gentle extinguishing medium is discharged for about three minutes, after which the extinguishing installation starts to supply more liquid.

The invention is described above only by means of one example, and it should therefore be noted that the invention can be implemented in many ways within the scope of the attached claims. Accordingly, the number of gas containers 1 and liquid containers 3 may vary. The number of spray heads 5 may naturally vary according to the application. The detailed structure of the valve 9 may differ from the one described. Consequently, for example instead of an extension spring 22, a compression spring can be arranged in the liquid space to achieve the same function. In some applications, the spring 22 may be arranged differently from the example such that it tends to load the spindle 13 in a direction tending to close the liquid inlet 11. The spring 22 is not necessarily needed at all. However, the spring 22 provides a simple way to regulate the operation of the valve 9 such that it corresponds to the requirements set by the application. The valve 21 is not either necessary. If the initial pressure in the gas container 1 is low, the throttles 7, 8 are not needed. The initial pressure in the gas container 1 is preferably high, allowing the pressure in the feed pipe 4 to be rendered relatively low with one or two throttles 7, 8.

What is claimed is:

1. A fire extinguishing installation comprising a liquid container connected to a gas container by means of a first line for discharging liquid from the liquid container via an outlet of the liquid container and a feed line to at least one spray head, the gas container being connected at a connection point via a second line to the feed line, and a valve, one opening of which is connected to the outlet of the liquid containe, and another opening of which is connected to the feed line, wherein the valve is coupled in parallel with the feed line and comprises a liquid chamber, connected via a line to the feed line;

an inlet for liquid, connected to the outlet of the liquid container;

a gas chamber, connected to the second line; and a spindle arranged between the liquid chamber and the gas chamber and movable between a first position, wherein the spindle closes the inlet such that the outlet of the liquid container is not in communication with the liquid chamber via the inlet and a second position, wherein the spindle opens the inlet such that the outlet of the liquid container is in communication with the liquid chamber via the inlet.

2. A fire extinguishing installation as claimed in claim 1, wherein the second line comprises a first throttle, and that the gas chamber is connected to the second line between the first throttle and the gas container.

3. A fire extinguishing installation as claimed in claim 1, further comprising a second throttle in the feed line between the outlet of the liquid container and the connection point, the second throttle being connected in parallel with the liquid chamber of the valve.

4. A fire extinguishing installation as claimed in claim 1, wherein the spindle comprises an action surface, on which the liquid pressure acts when the spindle is in the first position, a shoulder surface, on which the liquid pressure acts only when the spindle is in the second position, and a gas chamber surface, which points at the gas chamber and is larger than the action surface.

5. A fire extinguishing installation as claimed in claim 2, wherein the spindle comprises an action surface, on which the liquid pressure acts when the spindle is in the first position, a shoulder surface, on which the liquid pressure acts only when the spindle is in the second position, and a gas chamber surface, which points at the gas chamber and is larger than the action surface.

6. A fire extinguishing installation as claimed in claim 3, wherein the spindle comprises an action surface, on which the liquid pressure acts when the spindle is in the first position, a shoulder surface, on which the liquid pressure acts only when the spindle is in the second position, and a gas chamber surface, which points at the gas chamber and is larger than the action surface.

7. A fire extinguishing installation as claimed in claim 1, wherein the valve comprises a spring arranged to load the spindle.

8. A fire extinguishing installation as claimed in claim 2, wherein the valve comprises a spring arranged to load the spindle.

9. A fire extinguishing installation as claimed in claim 1, wherein the liquid container contains water.

10. A fire extinguishing installation as claimed in claim 2, wherein the liquid container contains water.

11. A fire extinguishing installation as claimed in claim 1, wherein the gas container contains incombustible gas.

12. A fire extinguishing installation as claimed in claim 2, wherein the gas container contains incombustible gas.

13. A fire extinguishing installation as claimed in claim 11, wherein the gas container contains nitrogen at a pressure of 50 to 300 bar.

14. A fire extinguishing installation as claimed in claim 13, wherein the first line is provided with a non-return valve, which is arranged to prevent a medium flow from the liquid container to the second line.

* * * * *

UNITED STATES PATENT AND TRADEMARK OFFICE

CERTIFICATE OF CORRECTION

PATENT NO. : 6,588,512 B2
DATED : July 8, 2003
INVENTOR(S) : Goran Sundholm

It is certified that error appears in the above-identified patent and that said Letters Patent is hereby corrected as shown below:

Title page,
Insert Item,
-- [30] Foreign Application Priority Data

Jun. 9, 2000 (FI) …….. 20001380 --.

Signed and Sealed this

Thirteenth Day of July, 2004

JON W. DUDAS
*Acting Director of the United States Patent and Trademark Office*